US006285271B1

(12) United States Patent
Bauer et al.

(10) Patent No.: US 6,285,271 B1
(45) Date of Patent: Sep. 4, 2001

(54) CAPACITOR SWITCHING CONTACTOR

(75) Inventors: Johann Bauer, Ebermannsdorf; Manfred Krones, Freihung; Reinhard Zinner, Bodenwöhr, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/462,601

(22) PCT Filed: Jun. 26, 1998

(86) PCT No.: PCT/DE98/01772

§ 371 Date: Mar. 31, 2000

§ 102(e) Date: Mar. 31, 2000

(87) PCT Pub. No.: WO99/03120

PCT Pub. Date: Jan. 21, 1999

(30) Foreign Application Priority Data

Jul. 10, 1997 (DE) ..... 197 29 595

(51) Int. Cl.[7] ..... H01H 67/02
(52) U.S. Cl. ..... 335/132; 335/202
(58) Field of Search ..... 335/6–10, 132, 335/202; 200/293–308; 439/810–814

(56) References Cited

U.S. PATENT DOCUMENTS

| | | | | |
|---|---|---|---|---|
| 4,539,541 | * | 9/1985 | Bharteey et al. | 335/132 |
| 4,595,812 | * | 6/1986 | Tamaru et al. | 200/307 |
| 5,323,132 | | 6/1994 | Abot et al. . | |
| 5,483,213 | * | 1/1996 | Mueller et al. | 335/132 |
| 5,872,498 | * | 2/1999 | Linek | 335/132 |

FOREIGN PATENT DOCUMENTS

| | | | |
|---|---|---|---|
| 31 05 117 | | 8/1982 | (DE) . |
| 91 00 244 | | 6/1992 | (DE) . |
| 2 735 279 | | 12/1996 | (FR) . |
| 6-131963 | * | 5/1994 | (JP) . |
| 6-131964 | * | 5/1994 | (JP) . |
| 6-131965 | * | 5/1994 | (JP) . |

* cited by examiner

*Primary Examiner*—Lincoln Donovan
(74) *Attorney, Agent, or Firm*—Kenyon & Kenyon

(57) ABSTRACT

A capacitor switching contactor is described which includes a standard contactor, an auxiliary switch, an input terminal block, an output terminal block, as well as resistance wires disposed between the terminal blocks, on the one hand, and the auxiliary switch, on the other hand. The resistance wires are connected to connecting terminals in chambers of the terminal blocks, and largely accommodated in the housing of the terminal blocks.

4 Claims, 6 Drawing Sheets

CAPACITOR SWITCHING CONTACTOR

FIELD OF THE INVENTION

The present invention relates to a capacitor switching contactor which has a standard contactor having main contacts, an auxiliary switch having auxiliary contacts which lead with respect to the main contacts, at least one resistance wire being connected in series each of the auxiliary contacts. The series connection of, in each case, one auxiliary contact and at least one resistance wire is connected on a phase by phase basis, in parallel, to one main contact, respectively. The contactor has input and output terminals for electrically coupling the series connections to the main contacts.

BACKGROUND INFORMATION

Capacitor switching contactors are generally known. FIG. 6 shows the fundamental electrical circuit of a capacitor switching contactor K. In this context, leading auxiliary contacts VK of an auxiliary switch are connected in parallel with main contacts HK of a standard contactor. The connecting leads from auxiliary contacts VK to main contacts HK are designed as resistance wires having the resistance $R_v$. In this context, individual input terminals 1,3,5 and individual output terminals 2,4,6 are used to connect the main conductors to the standard contactor and to couple the resistance wires. When a capacitor load 7 is switched in via the capacitor switching contactor according to FIG. 6, the leading auxiliary contacts VK of the auxiliary switch are first closed, thereby limiting the short-circuit type current inrush through resistors $R_v$ in this current path. The main contacts HK are then closed only after a time delay.

Usually, the resistance wires are run loosely in a plurality of loops according to the length required for the resistance value, and the ends are connected to the individual input terminals and individual output terminals.

German Patent No. 31 05 117 describes an electromagnetic switching device having main and leading contacts which are interconnected with damping series resistors in response to capacitive load. On the outgoing circuit side of main and leading contacts 2 and 3, respectively, resistors 14 are clamped with their ends into the terminals of one main and one leading contact, respectively. The resistors are formed as wire wraps and have an insulated design, and are each located between two dividing ribs of the housing, protected from external influences.

French Patent No. 27 35 279 describes a switching device having a covering, on whose inner side, flat resistance material is laid in a meander form.

Moreover, German Patent No. 92 00 344 describes an attachment housing having components to facilitate mounting on an electrical device having connecting terminals, preferably a contactor. The electrical components are used to interconnect an operating coil. A flexible connecting lead is provided for connecting the components to a coil terminal.

SUMMARY

An object of the present invention is to provide a capacitor switching contactor which is simple in design and renders possible a simple and fast assembly. The objective is achieved by combining the input terminals and the output terminals into one input terminal block and one output terminal block, respectively, having a housing with chambers which are insulated from one another in each case, disposed in which in each case is a connecting terminal that is electrically connected to a resistance wire, which is brought out from the housing of the input terminal block or output terminal block, respectively, to be connected to the auxiliary switch, and whose remaining length is accommodated in the housing.

This facilitates the assembly, since, instead of a plurality of individual input terminals and individual output terminals, terminal blocks may be coupled and connected to the standard contactor. Several not easily manipulable individual parts are replaced by one intrinsically stable connecting block, which, in addition to the connecting terminals, also accommodates the resistance wires. As a result, the resistance wires from the housing of the connecting block can be connected to the auxiliary switch without forming loops, i.e., the need is eliminated for the loops, which are a hindrance during assembly.

It is particularly advantageous for the resistance wire in the housing of the input terminal block or output terminal block to be accommodated in the same chamber as the connecting terminal that is electrically connected to it. In this specific embodiment, the difference in potential between the resistance wire and the connecting terminal electrically connected to it is relatively low in comparison with neighboring connecting terminals. In addition, the electrical stress, thus the probability of a short circuit, is kept at a minimum by the mutual insulation of the chambers. A further advantageous embodiment provides for designing the auxiliary switch, together with the input and output terminal blocks connected thereto via the resistance wires, as a subassembly, which is able to be coupled electrically and mechanically to the standard contactor. A subassembly of this kind is able to be coupled electrically and mechanically to the standard contactor, with little manipulation, i.e. the outlay for assembly is quite minimal. Incorrect connections and wiring are virtually ruled out.

It also proves to be especially expedient for the connecting terminals to be designed with a terminal area for conductor cross sections of up to 70 $mm^2$ and, in addition, with a terminal for connecting conductor cross sections of up to 2.5 $mm^2$, enabling an auxiliary conductor to be connected, in addition to the main conductor.

DETAILED DESCRIPTION

Figure 1:
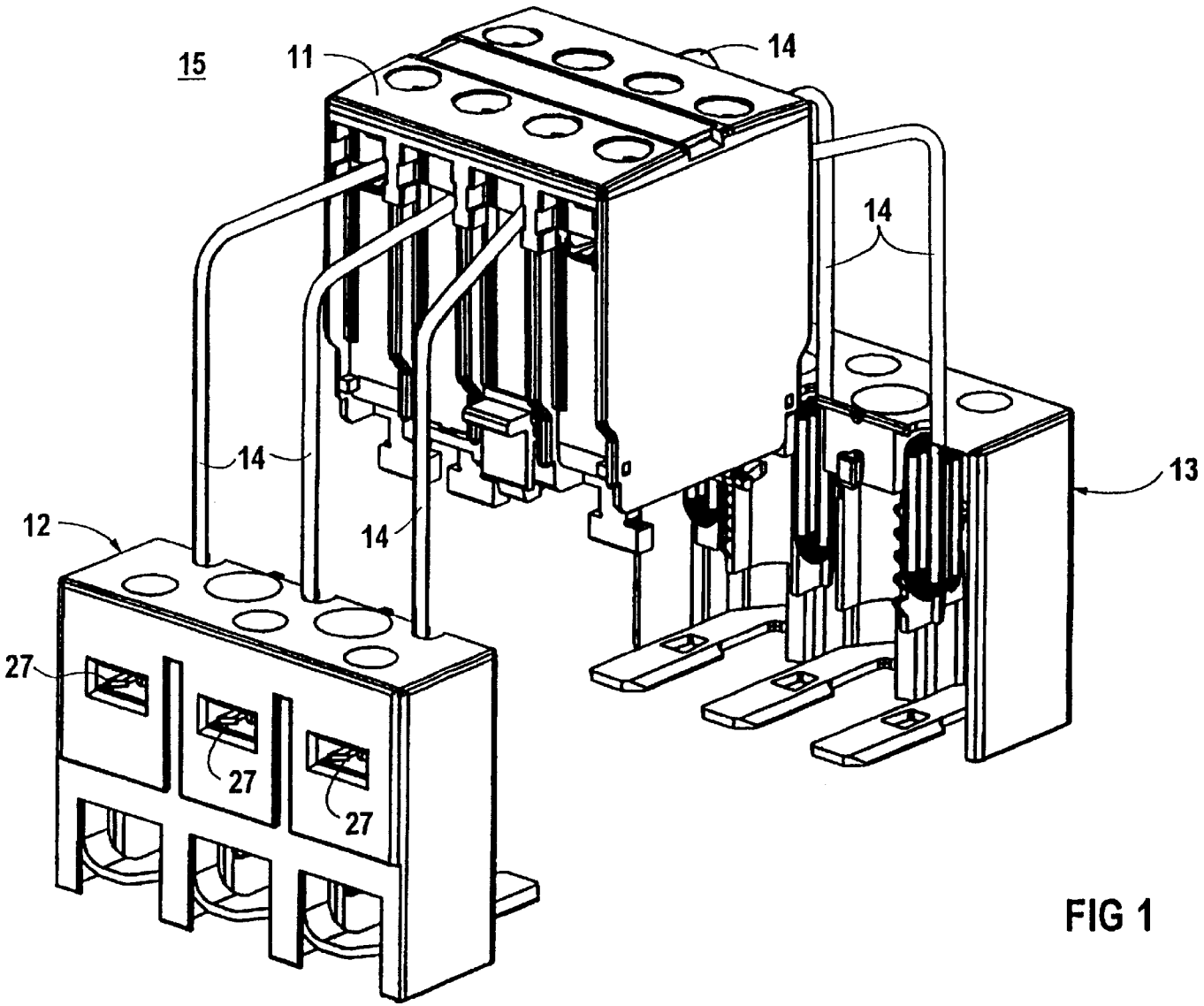
FIG. 1 shows a sub-assembly for a capacitor switching contactor, the subassembly being composed of an auxiliary switch, an input terminal block, an output terminal block, and resistance wires according to an example embodiment of the present invention.

FIG. 1 illustrates a subassembly 15 made up of an auxiliary switch 11, an input terminal block 12, an output terminal block 13, and resistance wires 14 interconnecting them. A capacitor switching contactor 17 according to FIG. 4 is obtained by mechanically and electrically connecting this subassembly 15 to a standard contactor 16.

Figure 2:
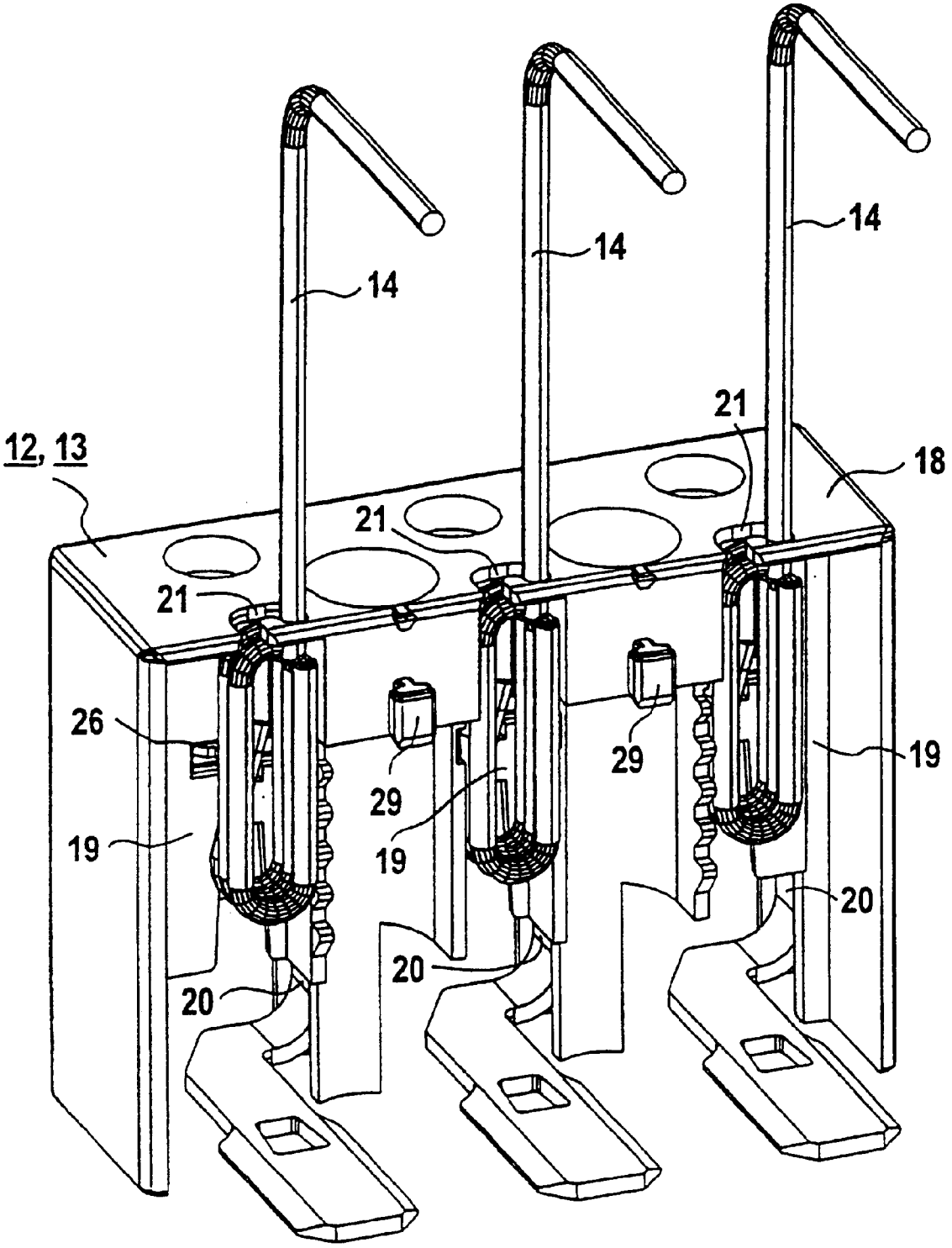
FIG. 2 shows the rear view of an input terminal block or an output terminal block, respectively.

FIG. 2 shows an input terminal block 12 or an output terminal block 13, respectively, as is used in subassembly 15 according to FIG. 1. The terminal block contains a housing 18 having three chambers 19, which are insulated from one another, are open to the bottom, and in each of is disposed a connecting terminal 20, as well as a resistance wire 14 electrically connected thereto.

Figure 3:
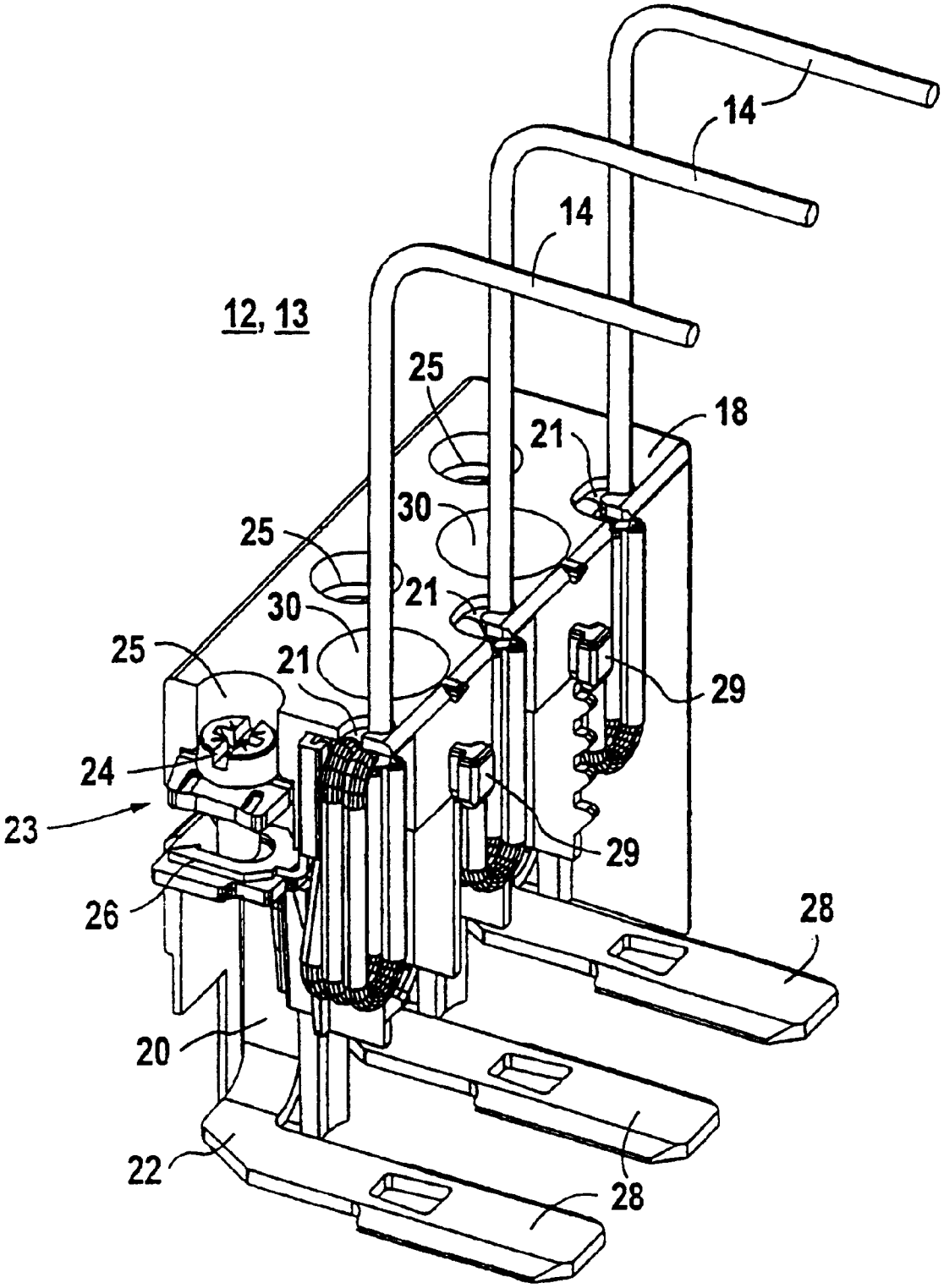
FIG. 3 shows a perspective view of an input terminal block or output terminal block, respectively, including the entire connecting terminal and the resistance wire attached thereto.

Resistance wires 14 have a length that is appropriate for the desired resistance value. The resistance wires 14 are brought out of an opening 21 in the top side of housing 18, with the length required for connection to auxiliary switches 11. The remaining length of resistance wire 14 is run in loops in the same chamber 19 as connecting terminal 20 that is connected to the resistance wire. In accordance with FIG. 3, connecting terminals 20 are each formed in their lower region as clips 22 and, in their upper region, as contact clips 23 having a combination screw 24 that is accessible via a hole 25 at the top side of housing 18. Resistance wire 14 is electrically connected to contact clip 23 by attaching the end of resistance wire 14, which is provided with a cable lug 26, to contact clip 23. Contact clips 23 are used to connect auxiliary conductors having a conductor cross-section of up to 2.5 $mm^2$. For this, the input terminal block and the output terminal block, respectively, have entry slots 27 at their front ends (see FIG. 1). Main conductors having a cross section of up to 70 $mm^2$ are able to be connected over the area formed as clip 22. The oblong extension prolongation 28 of clip 22, projecting out on the rear side of terminal block 12, 13, is used, in conjunction with the main conductors, for the connection to standard contactor 16.

Figure 4:
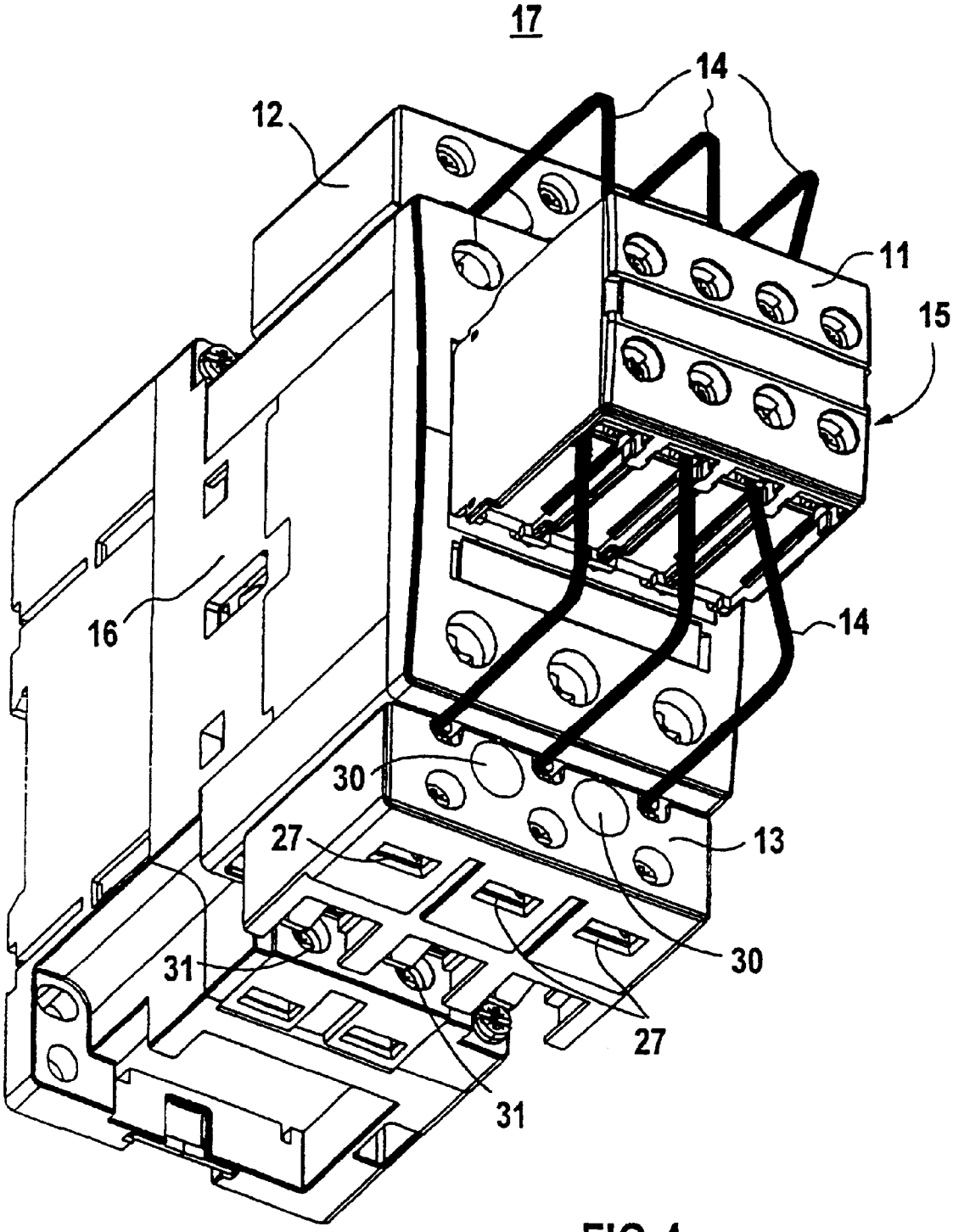
FIG. 4 shows the view of a complete capacitor switching contactor according to the example embodiment of the present invention.

FIG. 4 depicts the complete capacitor switching contactor 17 according to the present invention, where subassembly 15 is mounted on standard contactor 16. Of the four auxiliary contacts of auxiliary switch 11, three are used for the leading auxiliary contact functions of capacitor switching contactor 17, the fourth is not assigned. Input terminal block 12 and output terminal block 13 are coupled via fastening segments 29 (see FIGS. 2,3) which engage with slots (not shown here) in the side walls of standard contactor 16. Subjacent coil terminals 31 can be accessed by screwdriver via two through-holes 30 in input terminal block 12 and output terminal block 13, respectively.

Figure 5:
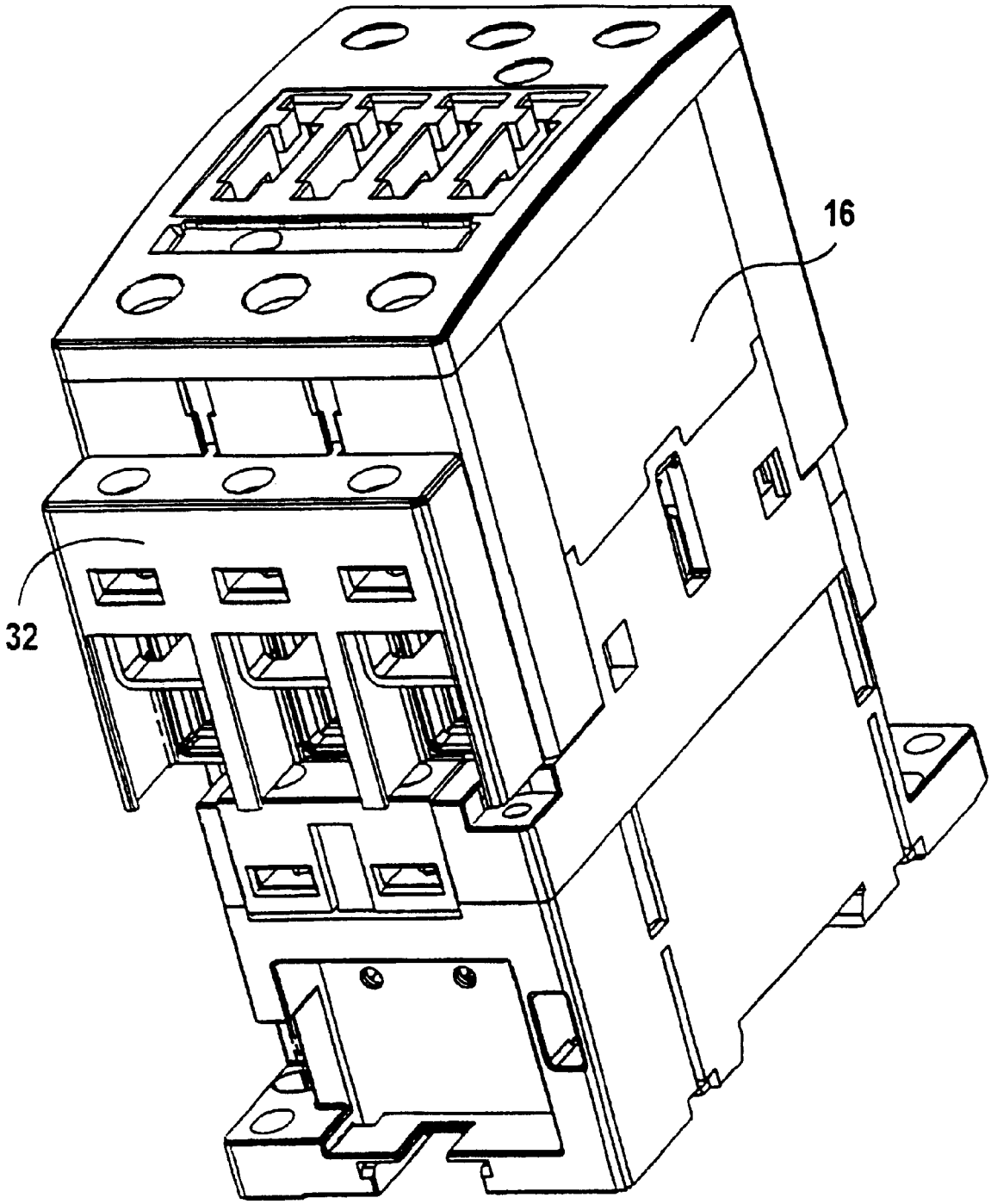
FIG. 5 shows a standard contactor having a terminal block for auxiliary conductor connection.
Figure 6:
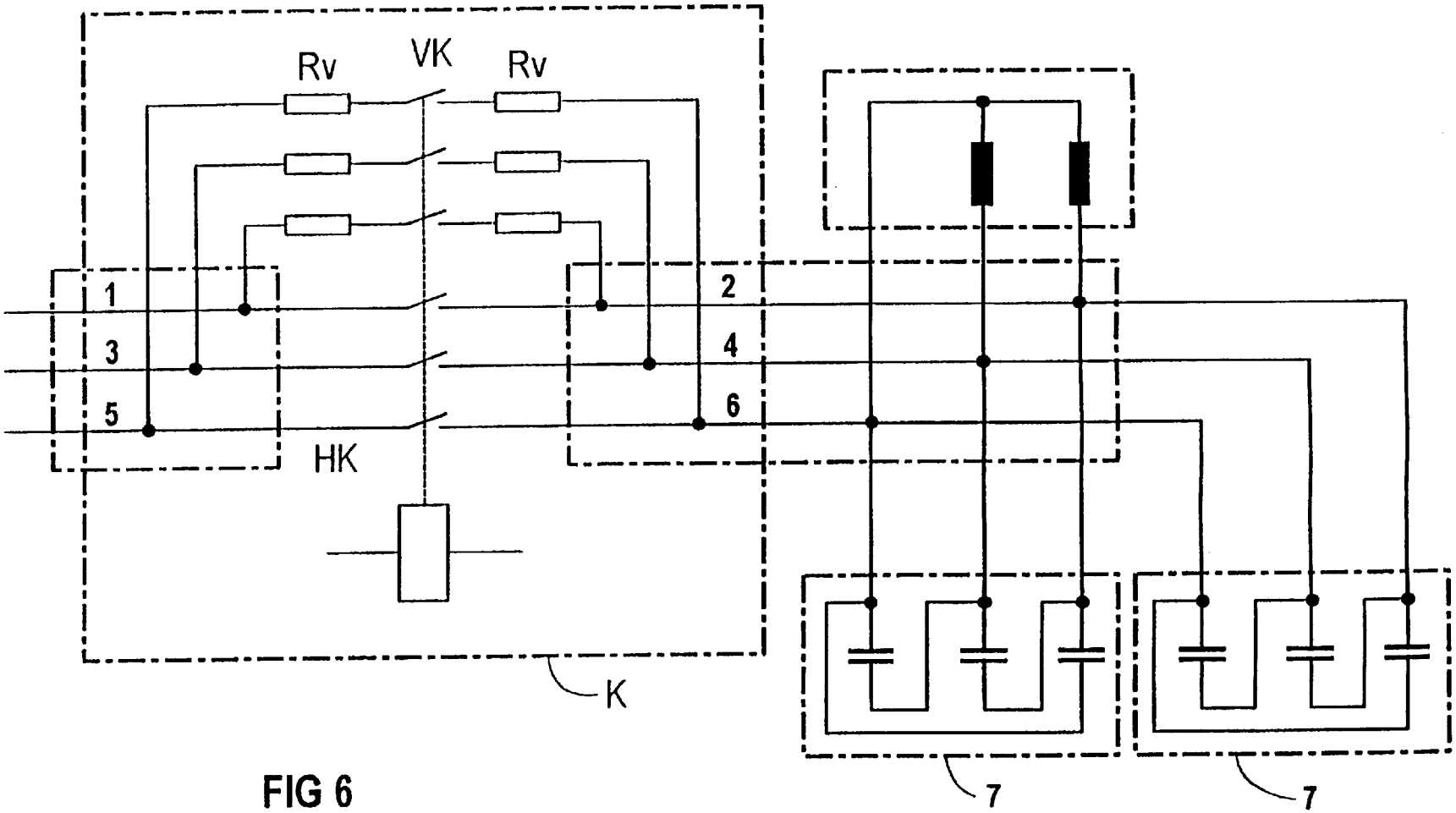
FIG. 6 shows the basic circuit diagram of a capacitor switching contactor.

FIG. 5 shows a standard contactor 16 having a side-mounted terminal block 32 which, besides the main conductor connection, also makes possible the auxiliary conductor connection. The design set-up including a housing having three chambers and the connecting terminals corresponds to that of input terminal block 12 and output terminal block 13, respectively. Since the need is eliminated for resistance wires, terminal block 32 is narrower in design, no provision being made either for through-holes 30 to access coil terminals 31.

What is claimed is:

1. A capacitor switching contactor, comprising:

a contactor including main contacts;

resistance wires;

an auxiliary switch including auxiliary contacts which lead with respect to the main contacts, each of the auxiliary contacts being connected in series to a respective one of the resistance wires to form a series combination, each series combination being connected, on a phase by phase basis, in parallel with a respective one of the main contacts; and an input terminal block and an output terminal block, each of the input terminal block and the output terminal block including a respective housing having chambers, the chambers being insulated from one another, each of the chambers having a connecting terminal disposed therein, the connecting terminal being connected to one of the resistance wires brought out from the respective housing of one of the input terminal block and the output terminal block to be connected to the auxiliary switch, a length of the one of the resistance wires being accommodated in the respective housing of the one of the input terminal block and the output terminal, the input terminal block and the output terminal block electrically connecting each series combination to the main contacts.

2. The capacitor switching contactor according to claim 1, wherein the length of the one of the resistance wires is accommodated in a same one of the chambers as the connecting terminal to which the one of the resistance wires is connected.

3. The capacitor switching contactor according to claim 2, wherein the auxiliary switch, together with the input terminal block and the output terminal block connected thereto via the resistance wires is designed as a subassembly, the subassembly configured to couple electrically and mechanically to the contactor.

4. The capacitor switching contactor according to claim 1, wherein each connecting terminal has a terminal area for conductor cross-sections of up to 70 $mm^2$ and includes a contact terminal for connecting conductor cross-sections of up to 2.5 $mm^2$.

* * * * *